US006679006B2

(12) United States Patent
Banicevic et al.

(10) Patent No.: US 6,679,006 B2
(45) **Date of Patent: *Jan. 20, 2004**

(54) THERMAL AND REINFORCED REFRIGERATOR DOOR

(75) Inventors: Nedo Banicevic, Hamilton (CA); Muc Dang, Burlington (CA)

(73) Assignee: Camco Inc., Mississauga (CA)

( * ) Notice: Subject to any disclaimer, the term of this patent is extended or adjusted under 35 U.S.C. 154(b) by 0 days.

This patent is subject to a terminal disclaimer.

(21) Appl. No.: 10/263,770

(22) Filed: Oct. 4, 2002

(65) Prior Publication Data

US 2003/0056465 A1 Mar. 27, 2003

Related U.S. Application Data

(62) Division of application No. 09/963,502, filed on Sep. 27, 2001, now Pat. No. 6,505,442.

(30) Foreign Application Priority Data

Aug. 14, 2001 (CA) ..... 2 359 419

(51) Int. Cl.[7] ..... E06B 3/00

(52) U.S. Cl. ..... 49/501; 52/656.4; 52/656.9; 52/657

(58) Field of Search ..... 49/397, 501; 52/656.4, 52/656.9, 657

(56) References Cited

U.S. PATENT DOCUMENTS

| | | | | |
|---|---|---|---|---|
| 92,205 | A | 7/1869 | Mullett et al. | |
| 1,194,646 | A | 8/1916 | Linden | |
| 1,230,567 | A | 6/1917 | Comee | |
| 1,630,100 | A | 5/1927 | Whittier | |
| 1,645,692 | A | 10/1927 | De Penning | |
| 1,914,646 | A | 6/1933 | Rand | |
| 2,413,597 | A | 12/1946 | Armstrong | 20/38 |
| 2,551,369 | A | 5/1951 | Frohnapel | 20/38 |
| 2,612,661 | A | 10/1952 | Semple | 20/38 |
| 2,652,601 | A | 9/1953 | Slopa et al. | 20/35 |
| 2,708,294 | A | 5/1955 | Saunders | 20/35 |
| 2,718,446 | A | 9/1955 | Hinkel | 312/214 |
| 2,725,271 | A | 11/1955 | Cunningham | 312/214 |
| 2,741,808 | A | 4/1956 | Rasmussen | 20/38 |

(List continued on next page.)

FOREIGN PATENT DOCUMENTS

| | | |
|---|---|---|
| JP | 46-10595 | 3/1971 |
| JP | 59-9032 | 3/1984 |
| JP | 1-200184 | 1/1989 |
| JP | 2-040482 | 2/1990 |

*Primary Examiner*—Jerry Redman

(57) ABSTRACT

A refrigerator door has reinforcing corner brackets that structurally complete the corners of the door. The corner brackets are located at the door corners adjacent vertical and horizontal side walls of the outer door skin of the door. At least one reinforcing member such as a sheet or rectangular collar, for example, or preferably reinforcing cross brace members are connected to the corner brackets. To achieve this connection and restrict heat transfer through the door and or adjacent the inner liner or in-turned flange of the outer door skin, the corner brackets have connecting tab portions that extend into the cavity of the door away from one of the side walls of the door and spaced from the other side wall of the door. The connecting tab portion is also spaced from the outer skin sheet and the inner door liner. As a result, the reinforcing member or members extend substantially across the width of the door spaced from the outer door skin wall and the inner door liner and are connected to the connecting bracket which is connected in heat transfer relation with side walls, horizontal or vertical, of the door. This reduces heat losses from the refrigerator cabinet conducted through the reinforcing member or members of the door.

12 Claims, 5 Drawing Sheets

U.S. PATENT DOCUMENTS

| | | | | | |
|---|---|---|---|---|---|
| 2,764,785 | A | | 10/1956 | Sulcek | 20/35 |
| 2,816,331 | A | | 12/1957 | Moore | 20/35 |
| 3,078,003 | A | | 2/1963 | Kesling | 220/9 |
| 3,091,946 | A | | 6/1963 | Kesling | 62/465 |
| 3,152,199 | A | | 10/1964 | Roberts | 264/45 |
| 3,240,029 | A | | 3/1966 | Wurtz | 62/273 |
| 3,250,041 | A | | 5/1966 | Anger | 49/501 |
| 3,563,845 | A | | 2/1971 | Stevens | 161/169 |
| 3,882,637 | A | | 5/1975 | Lindenschmidt | 49/501 |
| 3,948,407 | A | | 4/1976 | Puterbaugh | 220/4 |
| 4,005,919 | A | | 2/1977 | Hoge et al. | 312/214 |
| 4,084,347 | A | | 4/1978 | Brown | 49/397 |
| 4,087,143 | A | | 5/1978 | Barnard et al. | 312/138 |
| 4,107,833 | A | | 8/1978 | Knight | 29/460 |
| 4,142,766 | A | | 3/1979 | Swerbinsky | 312/214 |
| 4,151,681 | A | | 5/1979 | Roberts | 49/382 |
| 4,190,305 | A | | 2/1980 | Knight et al. | 312/214 |
| 4,267,682 | A | * | 5/1981 | Fowler et al. | 52/657 |
| 4,270,326 | A | | 6/1981 | Holter et al. | 52/404 |
| 4,282,687 | A | | 8/1981 | Teleskivi | 49/503 |
| 4,536,990 | A | | 8/1985 | Siegrist et al. | 49/501 |
| 4,585,129 | A | | 4/1986 | Lundqvist | 211/189 |
| 4,707,401 | A | | 11/1987 | Benford | 428/317.5 |
| 4,740,042 | A | | 4/1988 | Stich et al. | 312/138 |
| 4,747,245 | A | | 5/1988 | Lesmeister et al. | 52/309.7 |
| 4,779,939 | A | | 10/1988 | Stich | 312/214 |
| 4,787,133 | A | | 11/1988 | Lesmeister et al. | 29/460 |
| 4,878,700 | A | | 11/1989 | Brune | 292/241 |
| 5,042,396 | A | | 8/1991 | Shuert | 108/51.1 |
| 5,118,174 | A | | 6/1992 | Benford et al. | 312/406 |
| 5,369,901 | A | | 12/1994 | Revlett | 40/405 |
| 5,486,045 | A | | 1/1996 | Dasher | 312/406 |
| 5,505,031 | A | | 4/1996 | Heydon | 52/281 |
| 5,573,322 | A | | 11/1996 | Wrobel | 312/400 |
| 5,588,731 | A | | 12/1996 | Schmidt et al. | 312/405 |
| 5,599,081 | A | | 2/1997 | Revlett et al. | 312/406 |
| 5,655,351 | A | | 8/1997 | Pohl et al. | 52/784.15 |
| 5,909,937 | A | | 6/1999 | Jenkins et al. | 312/405.1 |
| 6,132,017 | A | * | 10/2000 | Gallegos | 312/140.1 |
| 6,138,432 | A | | 10/2000 | Banicevic | 52/784.15 |
| 6,185,898 | B1 | * | 2/2001 | Pratt | 52/657 |
| 6,192,630 | B1 | | 2/2001 | Banicevic et al. | 49/501 |
| 6,209,265 | B1 | | 4/2001 | Banicevic et al. | 49/501 |
| 6,505,442 | B2 | * | 1/2003 | Banicevic et al. | 49/501 |

* cited by examiner

THERMAL AND REINFORCED REFRIGERATOR DOOR

This application is a divisional application of U.S. patent application Ser. No. 09/963,502 filed Sep. 27, 2001, now U.S. Pat. No. 6,505,442 entitled "THERMAL AND REINFORCED REFRIGERATOR DOOR", which is incorporated herein by referenced in its entirety.

TECHNICAL FIELD OF THE INVENTION

The present invention relates to a door for a refrigerator having load reinforced corner brackets that support with improved thermal performance at least one door reinforcement member extending across the width of the door.

BACKGROUND OF THE INVENTION

For several years the trend in domestic refrigerator cabinets has been to increase the size and in particular the width of the food compartments and doors in top or bottom mount refrigerators.

Typically, the refrigerator door is constructed from an outer door panel of sheet steel material having rearwardly extending side walls. The door has an inner liner wall of plastic material attached to the door panel. Foam insulation is injected in the space between the outer panel and the inner liner. The foam expands and cures to thermally insulate and rigidify the door.

In order to conserve costs, the amount of steel used in the manufacture of these doors is optimized. The practice is to use a relatively thin sheet of steel for the outer panel. Often this sheet is in the order of 0.017 inches thick. Consequently, in order for the refrigerator door to maintain it's integrity and support articles or items stored on door mounted shelves, one common approach is to reinforce the door with cross braces located within the space of the door between the inner liner and the outer door panel. More typically, the metal cross braces extend adjacent the inner liner wall. The metal cross braces extend from the corners of the refrigerator outer panel in an X configuration across the width of the door to reinforce the refrigerator door. In some refrigerators, the braces are either attached directly to the outer door panel by being fastened to in-turned flanges that are parallel to and spaced from the outer door panel. In other refrigerators, cross brackets are attached to these in-turned flanges and extend across the door completing the base of a triangle with the door corner. The metal braces are attached to the cross bracket at the middle of the base of the triangle.

Another known approach to rigidify the door is to use a sheet of paper, aluminum foil or cardboard embedded adjacent the inner door liner in the insulation injected into the door cavity. This paper sheet is sufficiently large to cover the inside of the door and is taped to the door to prevent shifting. The sheet improves the rigidity of the door without significantly adding to the weight or cost of the door. Recently, metal sheets have been substituted for paper to improve rigidity. Even more recently, a rectangular shaped metal collar has been attached to the inner liner and a sheet of paper extends across the rectangular opening in the collar adjacent the inner door liner.

While the above described approaches in refrigerator door construction improve the rigidity of the door, these solutions are primarily directed to reinforcing the door outer skin and inner liner. To further strengthen the door outer skin, the corners of the door, formed when the skin is rolled back onto itself to provide a supporting peripheral flange for the door liner, have been welded to strengthen the corners.

Alternatively, metal brackets have been inserted into the corners of the door to which vertically extending posts or hollow tubes extending along the vertical wall have been used to strengthen the corners.

The problem with most of the door reinforcement that extends across the width of the door to rigidify the door is that some portion of the reinforcement is attached to an inside flange of the outer door shell where the liner periphery is attached closely adjacent the refrigeration cavity and or, the reinforcement is in heat transfer relation with the inner door liner that faces the refrigeration cavity when the door is closed. As a result, the a portion of the door reinforcement to the refrigeration cavity provides a heat conducting transfer medium that fluctuates in temperature as the door is opened and closed. Furthermore, a heat transfer path from the inside of the refrigeration cavity through the door reinforcement and door is present.

Clearly there is a need for a refrigerator door reinforcement that rigidifies the door, supports the corners of the door and at the same time restricts heat transfer through the inner door liner to the reinforcement and out through the door.

SUMMARY OF THE INVENTION

It is an object of the present invention to provide a refrigerator door construction having door corner brackets and one or more door reinforcement members attached to the brackets and extending across the width of the door that rigidifies the door and limits heat transfer through the door.

The present invention relates to a refrigerator appliance and, in particular, a door for a refrigerator appliance where the door includes reinforcing corner brackets that structurally complete the corners of the door. The corner brackets are located at the door corners adjacent vertical and horizontal side walls of the outer door skin. The brackets structurally support the horizontal and vertical side walls immediately adjacent the corner with a thicker, stronger material, such as, for example, metal or steel, so that loading normally transferred to the outer door skin through the horizontal side wall at this corner location is instead transferred directly to the brackets mounted in the door. In addition, the present invention connects at least one reinforcing member such as a sheet or rectangular collar, for example, or preferably reinforcing cross brace members to the corner brackets. To achieve this connection and restrict heat transfer through the door or adjacent the inner liner or in-turned flange of the outer door skin, the corner brackets have connecting tab portions that extend into the cavity of the door away from one of the side walls of the door and spaced from the other side wall of the door. The connecting tab portion is also spaced from the outer skin sheet and the inner door liner. As a result, the reinforcing member or members extend substantially across the width of the door spaced from the outer door skin wall and the inner door liner and are connected to the connecting bracket which is connected in heat transfer relation with side walls, horizontal or vertical, of the door. This reduces heat losses from the refrigerator cabinet conducted through the reinforcing member or members of the door.

In accordance with an aspect of the present invention there is provided a door for a refrigerator appliance comprising an outer door panel having an outer skin sheet with rearwardly extending peripheral vertical and horizontal side walls and four corners positioned between adjacent horizontal and vertical side walls. The door further comprises an inner door liner secured to the outer door panel spaced from the sheet to define a cavity between the inner liner and the sheet. The door comprises reinforcing corner brackets positioned within the cavity adjacent respective ones of the corners. The corner brackets each have a base wall extending substantially flush with, along and secured to at least one of the horizontal and vertical side walls to reinforce the corners. The base wall has a connecting tab member extending from the base wall and inwardly from the corresponding one of the horizontal and vertical side walls. The connecting tab member is spaced from the outer skin sheet and the inner door liner. The door further includes a pair of diagonally extending cross braces. Each cross brace has opposing end portions connected within the cavity to the connecting tab of diagonally opposed corner brackets and extending substantially across the door width within the cavity in spaced non-contacting thermal relationship from the outer skin sheet and the inner door liner to reinforce the door.

The horizontal side walls may have an open section adjacent the vertical side walls whereby the horizontal side wall ends at the open section. The brackets may each include a land section with an opening extending across the open section in the horizontal side wall for receiving a hinge pin in the opening of the land section.

The base wall of the bracket preferably extends along the horizontal side wall and the connecting tab member is spaced from the vertical side wall and extends into the cavity from the horizontal side wall. Alternatively, the base wall of the bracket extends along the vertical side wall and the connecting tab member is spaced from the horizontal side wall and extends into the cavity from the vertical side wall. Preferably, the base wall of the corner brackets is secured by toggle lock connection to a corresponding one of the horizontal and vertical side walls.

The outer door panel preferably has in-turned flanges extending from the horizontal and vertical side walls generally parallel to the outer skin sheet. The reinforcing corner brackets preferably each include a side flange that extends along an inside surface of the in-turned flanges of the horizontal and vertical side walls adjacent a respective corner. Preferably, portions of the side flange of the corner brackets extend beyond the in-turned flanges for connection to the inner door liner.

In an alternative embodiment, the reinforcing braces are replaced by a reinforcing metal sheet having connecting portions connected within the cavity to the connecting tabs of the corner brackets and extending substantially across the door width within the cavity in spaced non-contacting thermal relationship from the outer skin sheet and the inner door liner to reinforce the door. The reinforcing sheet may be continuous or form a rectangular frame or collar with a sheet of paper spanning the sheet.

BRIEF DESCRIPTION OF THE DRAWINGS

For a better understanding of the nature and objects of the present invention reference may be had to the following detailed description when taken in conjunction with the accompanying diagrammatic drawings wherein.

DETAILED DESCRIPTION OF EMBODIMENTS

Figure 1:
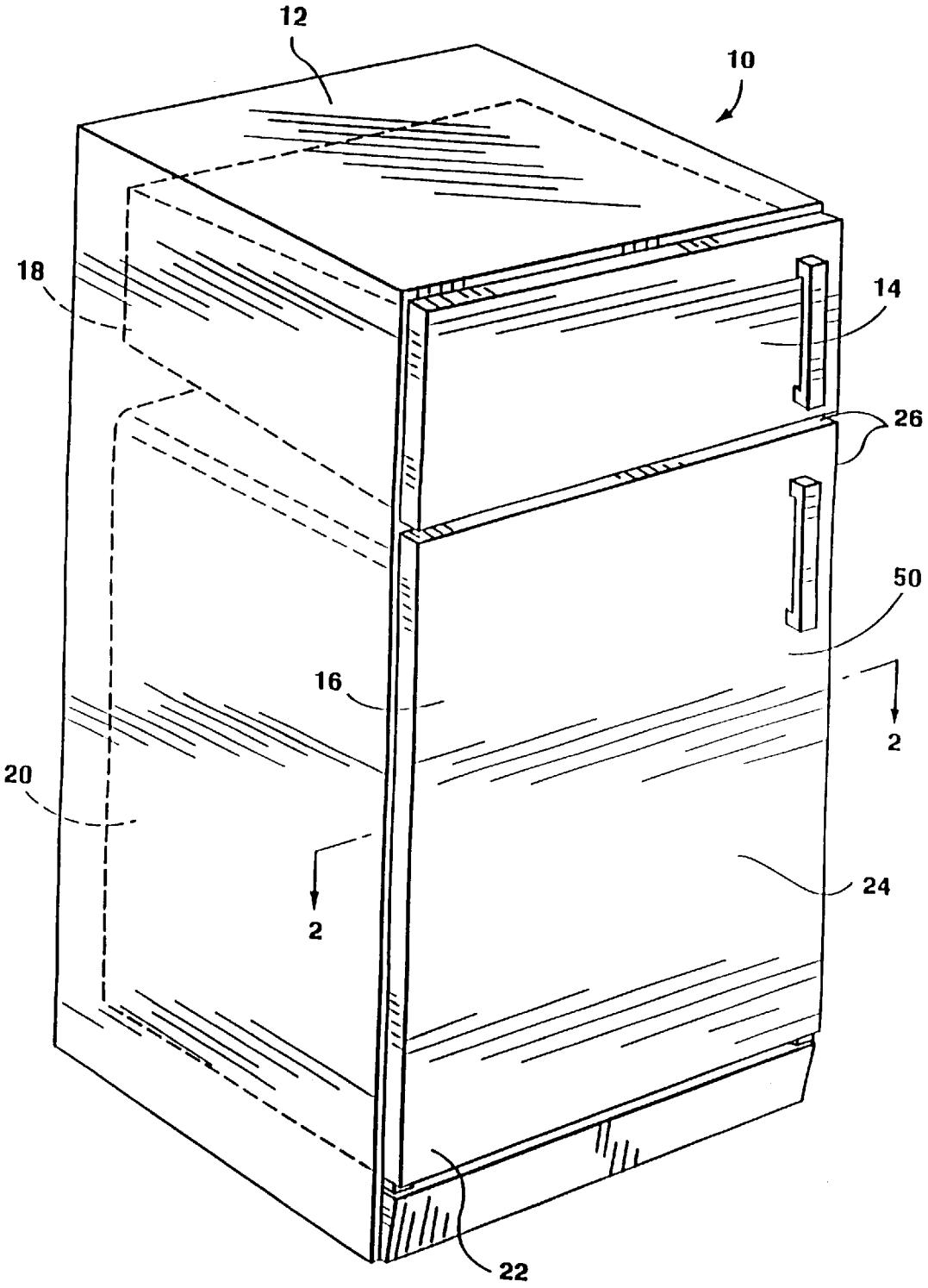
FIG. 1 is a perspective view of a top mount refrigerator appliance having top and bottom doors constructed in accordance with the present invention.

Referring to FIG. 1 there is shown a refrigerator 10 comprising a cabinet 12, a top door 14 and a lower door 16. Each of doors 14 and 16 are shown in a closed position. The top door 14 is typically adapted to close the freezer food compartment 18 and the lower door 16 typically closes the fresh food compartment 20. It is to be understood that the position of the freezer compartment 18 relative to the fresh food compartment 20 could be reversed as in a bottom mount refrigerator, or alternatively, the invention has application in side-by-side refrigerator doors.

Figure 2:
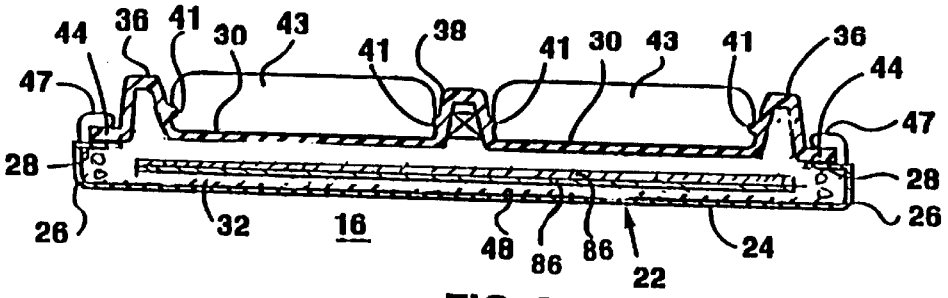
FIG. 2 is a sectional view taken at lines 2—2 of FIG. 1 showing the construction for a refrigerator door.
Figure 3:
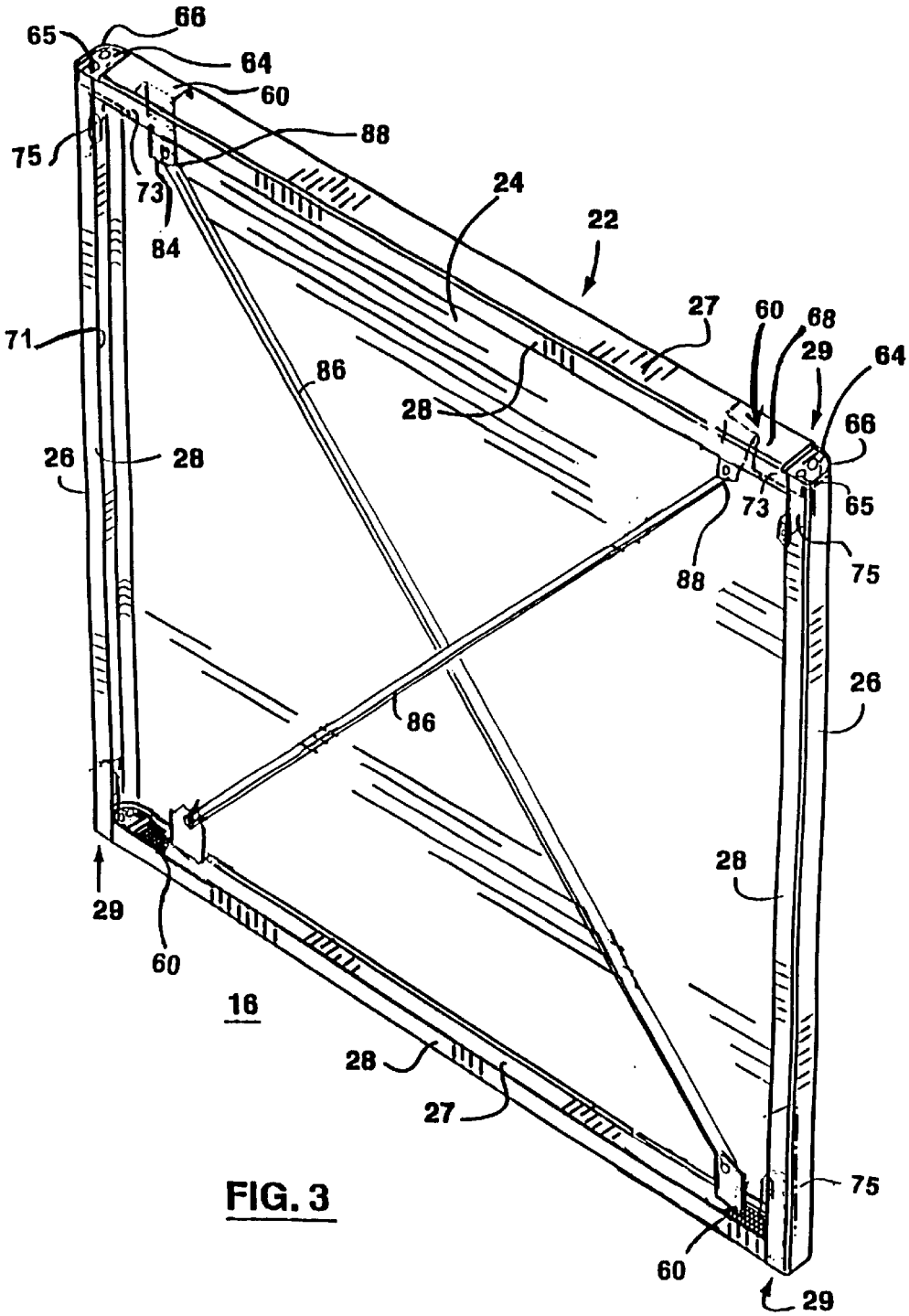
FIG. 3 is a perspective view showing the outer door skin from an inside view with the corner reinforcing brackets mounted to top and bottom side walls of the door outer skin and assembled with the reinforcing braces extending substantially across the door width within the door cavity away from the door inner liner.

In FIGS. 1 to 3 the preferred construction of door 16 is shown. Door 16 has an outer metal panel 22. Door panel 22 has a sheet or an outer skin sheet 24 with upstanding or rearwardly extending curved vertical side walls 26 and flat horizontal side walls 27. The vertical side walls 26 and horizontal side walls 27 extend towards each other and meet at corners 29. A cut-out or open section 64 is cut out from the horizontal side wall 27 at the corner 29 so that the horizontal side wall does not meet or join the vertical side wall 26. The vertical and horizontal side walls 26, 27 each further include in-turned flanges 28 that preferably extend parallel to the outer skin sheet 24 and overlap at the corners 29.

Referring to FIG. 2 an inner door liner 30 preferably of plastic material is mounted on top of the in-turned flanges 28 of the door panel 22. Liner 30 is spaced from the generally flat outer skin sheet 24 of the outer door panel 22 to define a cavity 32. The liner 30 has dyke side walls 36 and an interior vertical wall 30. Shelf supports 41 are integrally molded to walls 36 and 38. The shelf supports 41 carry shelves 43 which in turn carry articles (not shown). The liner 30 includes a peripheral edge or flange 44 secured by suitable screw fasteners (not shown) to the in-turned flanges 28 of the outer door panel 22. Mounted over the liner flange 44 and door panel flange 28 is a gasket 47 which seals the door in an airtight fashion with the refrigerator appliance 10. Foamed insulation 48 fills the cavity or space 32 defined between the liner 30 and the outer panel 22.

Figure 4:
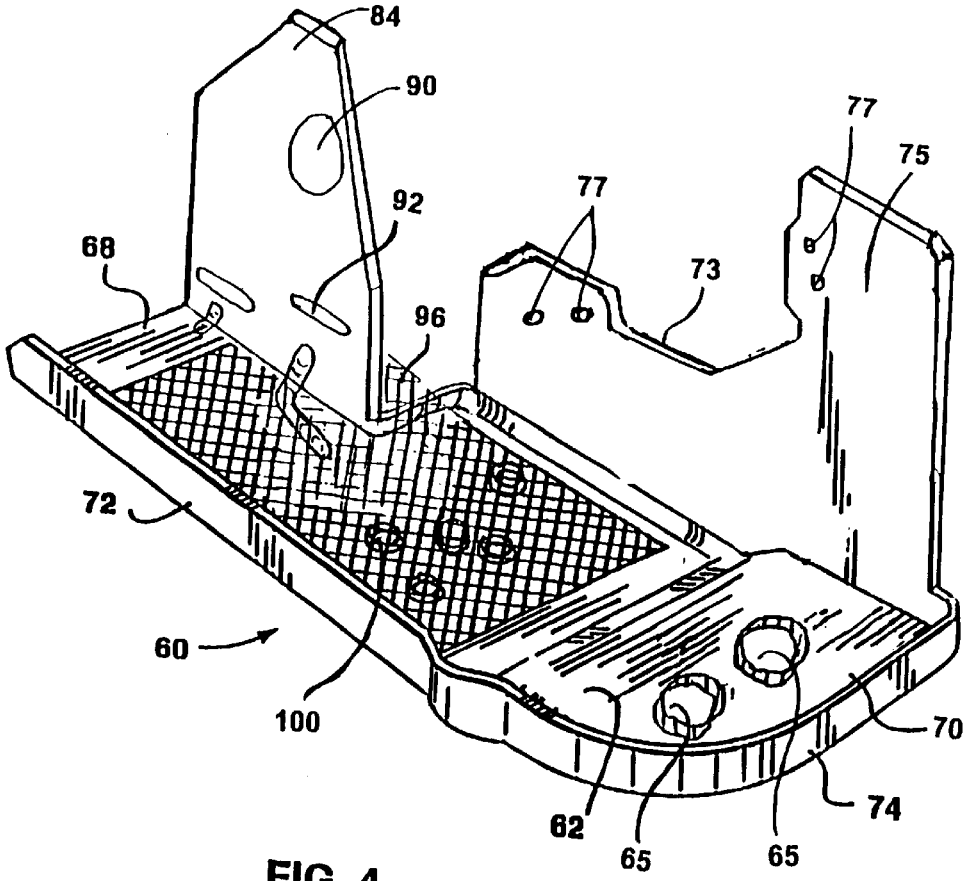
FIG. 4 is a perspective view of the bracket utilized in the lower left hand and upper right hand corners shown in FIG. 3.

Referring to FIGS. 3 and 4 reinforcing corner brackets 60 are shown positioned within the cavity 32 adjacent to the corners 29. Each bracket 60 comprises a plate 62 that extends across a removed or cut-out section 64 from the horizontal wall 27 at the corner 29 adjacent the vertical side wall 26. Plate 62 has two hinge pin receiving apertures 65 adapted to receive one hinge pin or an epaulet cover. The apertures 65 are of differing diameter to allow the brackets 60 to be used on different sizes of doors. The width of the bracket 60 is chosen to be substantially the width of the door 16 adjacent the horizontal wall 27 so that the bracket snugly fits into the door corners 29. The brackets 60 have a base wall 68. Base wall 68 has crimped openings 100 that are secured to the horizontal walls 27 in a toggle lock connection. The base wall 68 extends in abutting relation adjacent the horizontal side wall 27. The coiner bracket plate 62 also performs the function of a load bearing land section or surface portion at 70 that is recessed in spaced relation from the horizontal wall 27. The load-bearing portion 70 extends across the removed horizontal wall section 64 to engage in abutting relation the inside surface 71 of the vertical side wall 26.

The bracket plate 60 includes opposite side flanges 72, 73 and an end flange 74 which depend from the bracket plate 60 towards the interior cavity 32 of the door. The opposite side flanges 72, 73 respectively abut inside surfaces of the outer door skin 24 and the in-turned flange portions 28 associated with the horizontal side walls 27. Further flange 73 has portion 75 that abuts an inside surface of the in-turned flange 28 associated with the vertical side walls 26. Flange 73 is provided with fastener receiving holes 77 that are positioned inwardly of the in-turned flanges 28 to receive inner door liner securing fasteners so that the door liner is secured to these brackets 60 adjacent corners 29.

In accordance with the present invention, the reinforcing corner brackets 16 each include a connecting tab member 84 which depends from the base wall 68. The connecting tab member 84 extends from base wall 68 inwardly of the horizontal side wall 27. The connecting tab member 84 is spaced from both the outer skin 24 and the inner door liner 30 so as to be placed approximately within the center distance between these two surfaces 24 and 30.

To stabilize the door 16, a pair of diagonally extending cross braces 86 are shown in FIG. 3. Each cross brace 86 has opposing end portions 88 that are connected to openings 90 in the connecting tab members 84 by means of a weld joint. Referring to FIG. 4, there is shown two additional apertures 92 in the tab member. Additional apertures 92 are utilized for permitting a foam piece of insulation 96 to be placed above the connecting tab member 84 on top of the base wall 68 within the flanges 72 and 73. It should be understood that the foam insulation piece 96 is shown schematically and has a greater thickness than that shown to permit it to extend into or be connected with extra pieces that extend into slots 92 to hold in place relative to bracket 60.

The vertical cross braces 86 extend substantially across the width of the door 16 within the cavity 32 in spaced non-contacting thermal relationship from the outer skin sheet 24 and the inner door liner 30. The cross braces 86 have a V-shaped cross section to provide further strength in these metal cross braces. By connecting cross braces 86 through their end portions 88 with the connecting tab member 84 spaced from the outer door skin wall or sheet 24 and inner door liner 30, the thermal path through or along braces 86 is not in contact with an inner surface of the door that would either face, touch or abut the refrigerator compartment.

Figure 5:
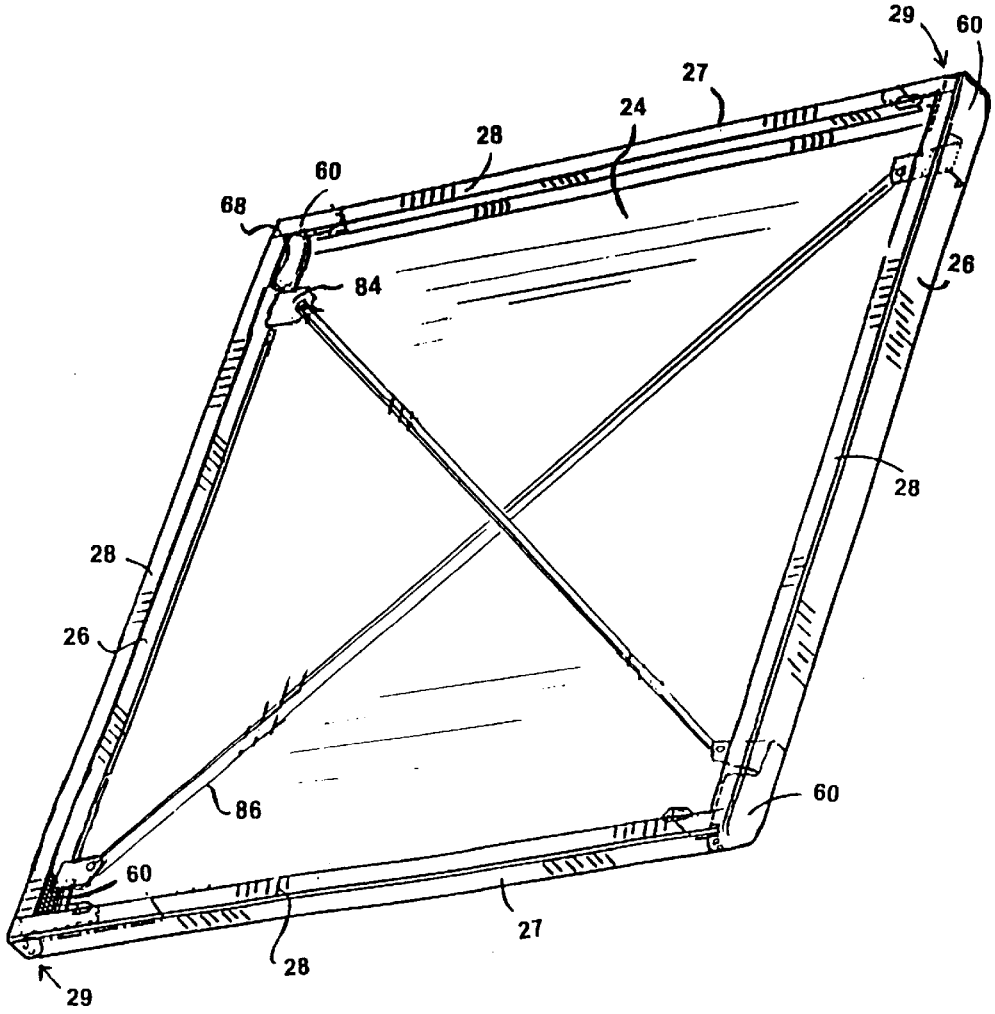
FIG. 5 is a perspective view showing the outer door skin from an inside view with the corner reinforcing brackets mounted to side walls of the outer door skin and assembled with the reinforcing braces extending substantially across the door width within the door cavity away from the door inner liner; and, FIG. 6 is a perspective view showing the outer door skin from an inside view with the corner reinforcing brackets mounted to top and bottom walls of outer door skin and assembled with a metal reinforcing sheet extending substantially across the door width within the door cavity away from the door inner liner.

Referring to FIG. 5, like numerals are used for the reinforcement of the door 16 wherein the cross braces 86 are connected to tab members 84 in the similar fashion as described for FIG. 3. However the brackets 60 are located with the substantial part of the base wall 68 extending flush and along the vertical side walls 26 such that the tab members 84 extend outwardly or inwardly into the cavity 32 away from the vertical side wall 26 and spaced from the horizontal side walls 27.

Figure 6:
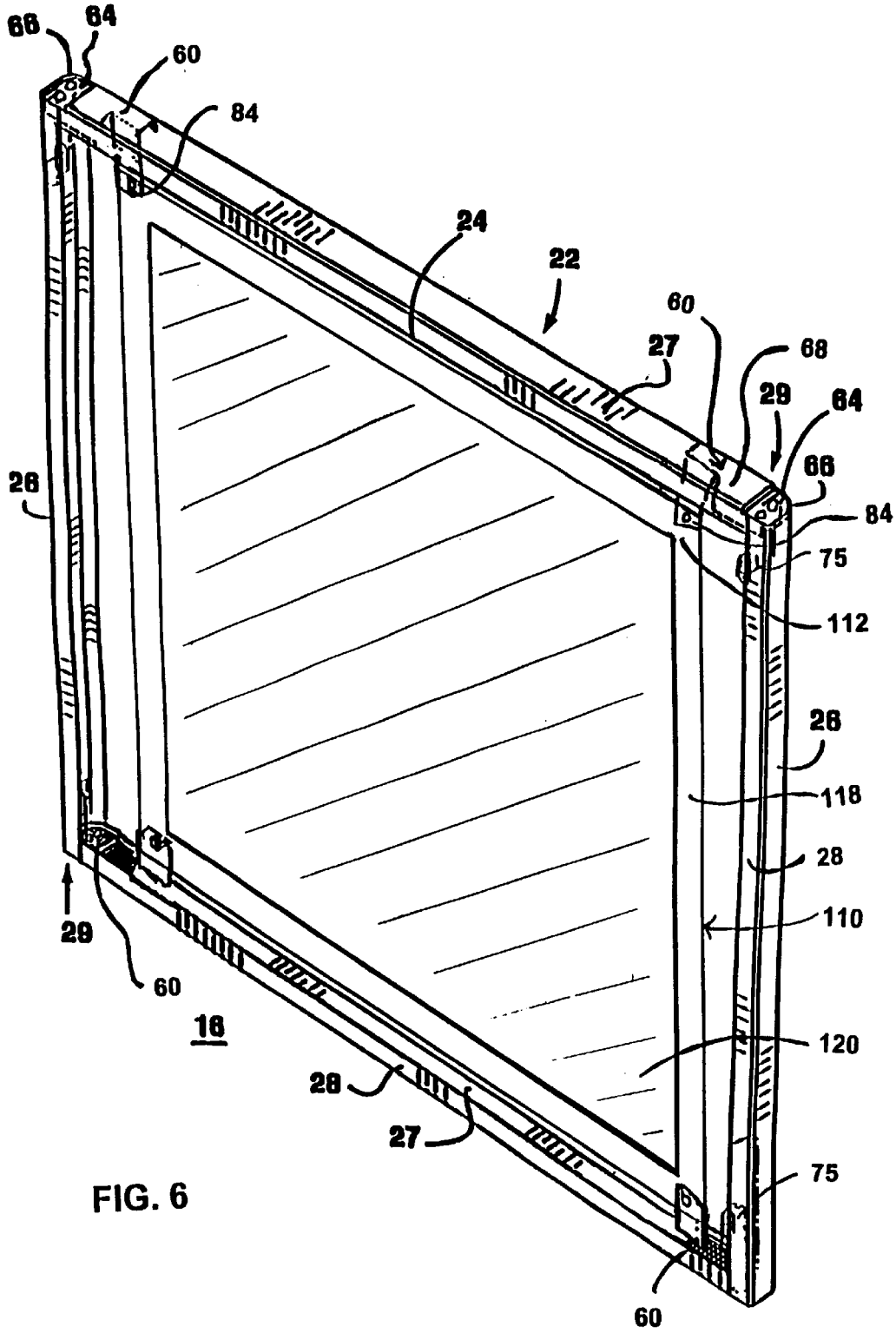

Referring to FIG. 6, there is shown a reinforcing sheet 110, preferably of a thin gauge of metal, that has corner portions 112 that are connected to the connecting tab members 84 by riveting or welding which are part of the corner bracket 60 located in the door in a similar fashion as described with respect to FIG. 3. This embodiment illustrates an alternate rigidifying feature that can be used. The continuous sheet 110 may comprise a collar or frame 118 having a central opening with a sheet of paper 120 secured to the frame 110 and extending across the central opening.

As is apparent from the foregoing disclosure, various other embodiments and alterations and modifications which may differ from the embodiments disclosed may be readily apparent to a person skilled in the art. It should be understood that the scope of the patent shall be defined by the claims and those embodiments which come within the scope of the claims that follow.

What is claimed is:

1. A door for a refrigerator appliance comprising:

an outer door panel having an outer skin sheet with rearwardly extending peripheral vertical and horizontal side walls, and four corners positioned between adjacent horizontal and vertical side walls;

an inner door liner secured to the outer door panel spaced from the outer skin sheet to define a cavity between the inner liner and the outer skin sheet;

reinforcing corner brackets positioned within the cavity adjacent respective ones of the corners, the corner brackets each having a base wall extending substantially flush with, along and secured to at least one of the horizontal and vertical side walls to reinforce the corners, and the base wall having a connecting tab member extending from the base wall and inwardly from the corresponding one of the horizontal and vertical side walls, the connecting tab member being spaced from the outer skin sheet and the inner door liner; and, a reinforcing sheet having connecting portions connected within the cavity to the connecting tab members of the corner brackets and extending substantially across the door width within the cavity in spaced non-contacting thermal relationship from the outer skin sheet and the inner door liner to reinforce the door.

2. The door for a refrigerator appliance of claim 1 wherein the reinforcing sheet is a continuous material substantially across the width of the door.

3. The door for a refrigerator appliance of claim 1 wherein the horizontal side walls have an open section adjacent the vertical side walls whereby the horizontal side wall ends at the open section.

4. The door for a refrigerator appliance of claim 3 wherein the brackets each include a land section with an opening extending across the open section in the horizontal side wall for receiving a hinge pin in the opening of the land section.

5. The door for a refrigerator appliance of claim 1 wherein the base wall of the bracket extends along the horizontal side wall and the connecting tab member is spaced from the vertical side wall and extends into the cavity from the horizontal side wall.

6. The door for a refrigerator appliance of claim 1 wherein the base wall of the bracket extends along the vertical side wall and the connecting tab member is spaced from the horizontal side wall and extends into the cavity from the vertical side wall.

7. The door for a refrigerator appliance as claimed in claim 1 wherein the outer door panel includes in-turned flanges extending from the horizontal and vertical side walls generally parallel to the outer skin sheet, and the reinforcing corner brackets each including a side flange that extends along an inside surface of the in-turned flanges of the horizontal and vertical side walls adjacent a respective corner.

8. The door for a refrigerator of claim 7 wherein portions of the side flange of the corner brackets extend beyond the in-turned flanges for connection to the inner door liner.

9. The door for a refrigerator appliance of claim 1 wherein the base wall is secured by toggle lock connection to a corresponding one of the horizontal and vertical side walls.

10. The door for a refrigerator appliance of claim 1 further including foam insulation in the cavity extending around the reinforcing sheet and the connecting tab members of the corner brackets.

11. The door for a refrigerator appliance as claimed in claim 1 further including a door sealing gasket extending over the in-turned flange of the side walls of the door.

12. The door for a refrigerator appliance of claim 1 wherein the reinforcing sheet comprises a metal frame with a central opening and paper mounted to the frame extending across the central opening.

* * * * *

UNITED STATES PATENT AND TRADEMARK OFFICE

CERTIFICATE OF CORRECTION

PATENT NO. : 6,679,006 B2
DATED : January 20, 2004
INVENTOR(S) : Banicevic et al.

It is certified that error appears in the above-identified patent and that said Letters Patent is hereby corrected as shown below:

Title page,
Item [30], Foreign Application Priority Data, should read
-- June 14, 2001 (CA) …….. 2 350 419 --

Signed and Sealed this

Thirteenth Day of April, 2004

JON W. DUDAS
*Acting Director of the United States Patent and Trademark Office*